United States Patent [19]

Guyomard et al.

[11] Patent Number: 4,876,111

[45] Date of Patent: Oct. 24, 1989

[54] METHOD FOR DEPOSITING A PRIMER OR SEALER OF PROGRAMMED COLOR ON AN OBJECT

[75] Inventors: Daniel Guyomard, Lamorlaye; Gérald Torrez, Liancourt; Jean-Michel Lambour, Pont-Sainte-Maxence; Claude Arriveau, Argent-sur-Sauldre, all of France

[73] Assignee: B.A.S.F. Peintures & Encres S.A., France

[21] Appl. No.: 106,556

[22] Filed: Oct. 6, 1987

[30] Foreign Application Priority Data

Oct. 6, 1986 [FR] France ..... 86 13892

[51] Int. Cl.[4] ..... B05D 1/06; B05D 1/34

[52] U.S. Cl. ..... 427/31; 239/3; 239/7; 427/426

[58] Field of Search ..... 118/626, 712, 302; 427/426, 31, 8; 239/3, 7, 214.25, 222.19, 223, 224, 696, 700, 703

[56] References Cited

U.S. PATENT DOCUMENTS 3,411,715 11/1968 Wallis ..... 239/700 X

FOREIGN PATENT DOCUMENTS 3135721 3/1983 Fed. Rep. of Germany .
347743 8/1960 Switzerland .

OTHER PUBLICATIONS

Highland, H. J., "Audels Painting and Decorating Manual," New York, Theodore Audel & Co., 1971, p. 258.
Tholome et al., "Breakthrough in Automatic Painting", *Finishing*, Nov. 1977, pp. 30–35.

*Primary Examiner*—Evan Lawrence
*Attorney, Agent, or Firm*—Ostrolenk, Faber, Gerb & Soffen

[57] ABSTRACT

A method and apparatus for depositing a primer of programmed color on an object are described. In the method, a neutral primer base and at least one mono- or poly-pigmented paste are fed independently to a projection or spray device such an electrostatic deposition device comprising a rotary bowl. The base and paste are mixed in the device simultaneously while being projected or sprayed on the object.

7 Claims, 2 Drawing Sheets

30
28
8
4
5
7
2
12a
26
24
12
6
18
10
14
22
16
20
1

METHOD FOR DEPOSITING A PRIMER OR SEALER OF PROGRAMMED COLOR ON AN OBJECT

The invention relates essentially to a method and to apparatus for depositing a primer or sealer of programmed color on an object, in particular motor vehicle bodywork, by mixing a neutral base primer and one or more pigmented pastes at the moment the primer is deposited on said object.

BACKGROUND OF THE INVENTION

Numerous apparatuses are already known in industry, and in particular in the automotive industry, for depositing paint on objects, in particular on motor vehicle bodywork.

In general, vehicles are "recognized" by computer means for their finishing colors.

In practice, various projection devices are used, in particular electrostatic projection devices which may include bowl-shaped rotating head systems. Such devices may be coupled to an automatic color changer. This assembly then allows the complete unit to change vehicle color. Further, before applying the final color to a vehicle, i.e. the finishing color, a primer or sealer which is generally a single gray color is applied in the great majority of cases. However, for some finishing colors, and in particular yellows and reds, are known for their lower opacifying power, gray primer is unsatisfactory and thus contributes to considerably increasing the return rate for defects.

The use of "false color" primers, i.e. primers of color similar to the finishing color, in order to facilitate the industrial use of finishing colors of low opacifying power on a mass production line has suffered, heretofore, from several drawbacks.

A given production site works, on average, with a palette of 15 to 20 different colors. Thus, in order to avoid excessively complicating management and equipment, it would seem reasonable to provide for 3, 4, or 5 "false color" primers.

However, present installations are generally not suitable for setting up one or more additional paint circuits or paths, and the cost of adding such paint circuits as would be necessary for using new primer colors in a production line has often been judged to be much too high.

Even in a new installation, the extract cost resulting from such a choice is phohibitive both because of the extra equipment that needs to be installed and also because of requisite materials need storage, and in addition, it has been observed that even when 3, 4, or 5 "false color" primers are available it is still not possible to adapt the color of the primer adequately to some finishing colors so that there is still a return rate due to defects which is unacceptable, in particular when taking account of the extra production costs resulting from the presence of a plurality of primers and paint circuits.

The present invention thus seeks to solve the new technical problem consisting in providing a solution for simplifying primer technology by virtue of using a single primer which requires only one main paint circuit and which is capable of being adapted at will on site to an appropriate primer color as a function of any given finishing color.

The invention also seeks to solve the complementary technical problem concerning the losses of material related to purging operations when changing color as are required by color changes such as those used for finishing colors.

The present invention also seeks to solve the technical problem consisting in providing a method and an apparatus enabling investment costs to be kept down.

All of these technical problems are solved for the first time in satisfactory manner by the present invention.

SUMMARY OF THE INVENTION

Thus, according to a first aspect, the present invention provides a method of depositing a primer or sealer or the like of programmed color on an object, in particular on motor vehicle bodywork, characterized in that initally a neutral primer base and at least one mono- or poly-pigmented paste are prepared, and in that said neutral primer base and said pigmented paste are then mixed in order to constitute said primer at the moment the primer is deposited on said object.

According to an advantageous characteristic of the method of the invention, the pigmented primer is measured out in order to determine the desired primer color.

According to another characteristic of the method of the invention, in which the primer is projected or sprayed on, said method of the invention is characterized in that said neutral base and said pigemented paste are fed independently to the projection or spray device in such a manner as to cause them to be mixed simultaneously while being projected or sprayed.

Thus, supposing the primer is being deposited, for example, by the elastrostatic technique, the neutral base and the pigmented paste are brought independently to the electrostatic device which may advantageously be a rotary device and include an electrostatic bowl. The neutral base and the pigmented paste may be brought independently substantially up to the level of the projecting surface of the bowl or to the rear of the bowl, thereby enabling at least partial mixing to take place upstream from the projecting surface.

Advantageously the method includes the following steps:

(a) all of the finishing colors are classified and grouped into families depending on their colorimetric characteristics, which are measured by means of a spectrophotocolorimeter, optionally with computer assistance;

(b) the average colorimetric values of the colors of each family are determined for giving to the primer of each family and in such a manner as to determine the formulation of the corresponding pigmented compositions;

(c) the pigmented pastes corresponding to said compositions are prepared;

(d) a neutral primer base is prepared having substantially the same pigment concentration per unit volume as the pigmented paste selected in this manner; and (e) the neutral pigment base and the pigmented paste are fed independently to the device for spraying or projecting primer onto said object.

In a second aspect, the present invention provides apparatus for depositing a primer of programmed color on an object, in particular on motor vehicle bodywork, the apparatus comprising means for depositing the primer on said object, and being characterized in that it includes first means for feeding a neutral primer base to said primer depositing means from a neutral base circuit connected to a supply of neutral base, and second means for feeding pigmented paste to said depositing means independently from the first means, which second means are connected to a supply of pigmented paste; said first means and said second means co-operating with said depositing means in such a manner as to mix said neutral base and said pigmented paste in order to form said primer at the moment at which it is deposited on said object.

Further, when the primer is being deposited by the electrostatic technique, the apparatus comprises an electrostatic spray device, generally in the form of a bowl which is advantageously a rotary bowl. In this case, the independent feeds of neutral primer base and of pigment paste open out in accordance with a presently preferred first embodiment, independently and substantially in the vicinity of the projecting surface of the bowl. However, it is also possible for the independent feeds of neutral primer base and of pigmented paste to be brought to the rear of the bowl, for example on its axis.

The following advantages are thus obtained:

a single paint circuit is used for the base primer which represents about 70% to 90% of the entire primer, plus a small supply of pigmented paste, representing about 30% to 10% of the total primer, for each desired primer color;

the quantity of pigmented paste added at the moment of use can be accurately measured, at will;

this measured quantity of pigmented paste can be programmed at will, enabling a program-controlled tool to be used;

in a simplified version, the neutral base to pigmented paste ratio is fixed at 9:1, for example, and is determined in practice by the relative areas of the respective injectors for injecting the base and the pigmented paste, both of which are fed by circuits in which the pressure is maintained at the same value;

the invention has a universal nature in that all kinds of projection or spray devices can be used, so can all types of paint, regardless of whether they are have a high dry content, are water based, or are solvent based; and the neutral primer base and the pigmented paste are advantageously mixed together as close as possible to the point from which they are projected or sprayed, thereby limiting losses of substance related to purging operations when changing color.

Pigmented pastes are prepared in several different colors and are delivered selectively from a manifold device having as many lines as there are colors.

The problem of stocks is thus solved to a very large extent since, for example, using four colored primers no longer corresponds to roughly quadrupling stocks but only to increasing them by about 40% compared with using a single gray primer.

Providing the feed is programmable, it is easy to change color rapidly between two successive vehicles.

Practical experience on a production line has shown that the proposed configuration is capable of changing color in less than ten seconds.

Practical tests have shown with colored primers that it is possible to use a single coat on interiors, and that the reject rate relating to poor covering on sharp edges is considerably reduced.

Manual lacquering operations are also reduced.

Satisfactory measuring accuracy can be obtained using bowl feed circuits where the areas of the injector orifices are of a fixed ratio lying, for example, in the range 1 to 10, and the device can do without a more sophisticated and thus more expensive system such as a system including a metering pump.

The first step in implementing the method of the invention consists in selecting the color of the primer. To this end, the set of finishing colors are analyzed and grouped into families by means of a spectrophotometer coupled to a computer. Each color is defined by three numerical values representing the co-ordinates of a point in "color space".

H is Hue, with a value lying between 0 and 999 to describe the entire range of spectral colors around a circle;

L is Lightness, with a value lying between 0 and 99 to give the degree of whiteness along a vertical axis passing through the center of the circle; and S is Saturation, with a value lying between 0 and 99 where 0=completely unsaturated and 99=a very pure or fully saturated color. This value corresponds to the radius of the H circle.

Diagram of "color space"

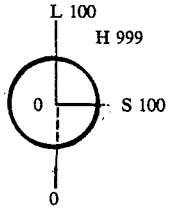

Using these values, colors which are close together are grouped together in families corresponding to a dispersion of points. The center of gravity in normalized HLS values is the color of the best primer for receiving a given set of finishing colors since the center of gravity is in the middle of the dispersion.

However, for very pale finishing colors, it has been shown that lightness L is an overriding factor, in which case the reflectance value of the primer is selected to have a value which is greater than the reflectance values of the finishes under consideration.

A computerized color data base makes it possible to physically locate a color if necessary. Using these HLS values and a computer program for formulating color, it is possible to determine the most suitable pigment composition for use in a given car primer.

HLS values are given by way of example and any other known color classification system could be used: Lab, Lab*, XYZ, etc. It is also possible to displace the center of gravity in order to take account of specific problems relating to some of the colors in a group, in particular their specific opacifier properties, their popularity, and the reject rate associated with said colors.

This operation may also be used to determine the number of colored primers that are used, and their colors.

BRIEF DESCRIPTION OF THE DRAWINGS

Embodiments of the invention are described by way of example with reference to the accompanying drawings, in which.

DETAILED DESCRIPTION

Figure 1:
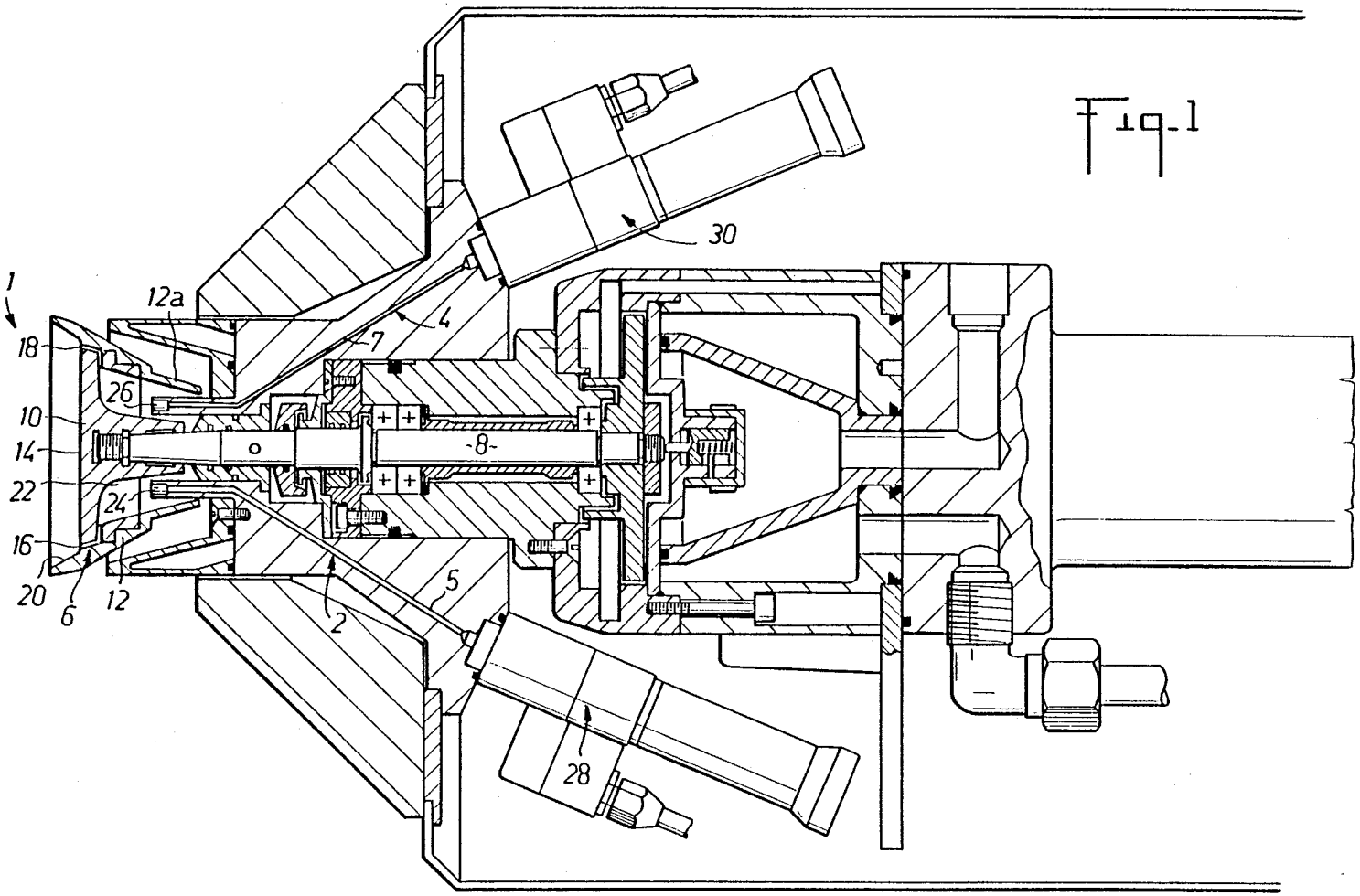
FIG. 1 is a section view through a projection or spray device for electrostatic deposition, the device being of the type having a rotary bowl including independent means for feeding neutral base and pigmented paste, said means terminating substantially level with the rotary bowl so that mixing takes place on the rotary bowl.

With reference to FIG. 1, an apparatus for depositing a primer of programmed color on an object, in particular on motor vehicle bodywork, comprises means for depositing primer on the object and given overall reference numeral 1.

In accordance with the invention, this apparatus includes: first means 2 for feeding the primer depositing means with a neutral primer base taken from a paint circuit (not shown) for neutral base which circuit is connected to a store of neutral base (also not shown); and second feed means 4 for feeding pigmented paste, with the second means being independent from the first means 2 and being connected to a store of pigmented paste (not shown). The first means 2 and the second means 4 co-operate with the deposition means 1 in such a manner as to mix the neutral base and the pigmented paste appropriately, in a manner equivalent to conventional prior preparation of a primer of predetermined color.

In the embodiment shown in FIG. 1, which is the presently preferred embodiment, the depositing apparatus is constituted by an electrostatic depositing device comprising a rotatary bowl 6 rotatably mounted on a drive shaft 8 which is rotated by conventional means as are well known to the person skilled in the art. More precisely, the rotary bowl 6 comprises a central portion 10 fixed to the rotary shaft 8 and a peripheral envelope 12 which is substantially frustoconical in shape and projects from the sides of the central portion 10 which has a visible surface 14 in the form of a substantially flat disk. Where the central portion 10 meets the peripheral portion 12, there are several orifices 16, 18 for allowing primer to pass close to the inside surface 20 of the envelope 12 which constitutes the projecting surface of the rotary bowl.

It will readily be understood that the first means 2 and the second means 4 respectively comprise a first duct 5 and a second duct 7 terminating in the reception cavity 22 defined between the rear frustoconical portion 12*a* of the envelope 12 and the central portion 10 of the rotary bowl 6.

It may be observed that because of their different flow rates, the duct 5 for feeding the neutral primer base has a right cross-section with an area greater than that of the duct 7 for feeding the pigmented paste, with the pigmented paste generally only constituted about one-tenth of the primer whereas the neutral base constitutes about nine-tenths. Advantageously, the ducts 5 and 7 open out into the cavity 22 via respective calibrated orifices 24 and 26. Also, respective injector devices 28 and 30 are provided for enabling the neutral base and above all the pigmented paste to be metered at will.

In operation, it is clear that the neutral primer base and the pigmented paste mix in the cavity 22 and while being projected from the rotary bowl.

The invention is particularly adapted to electrostatic type deposition, but other deposition techniques could also be used without limitation on the invention.

Figure 2:
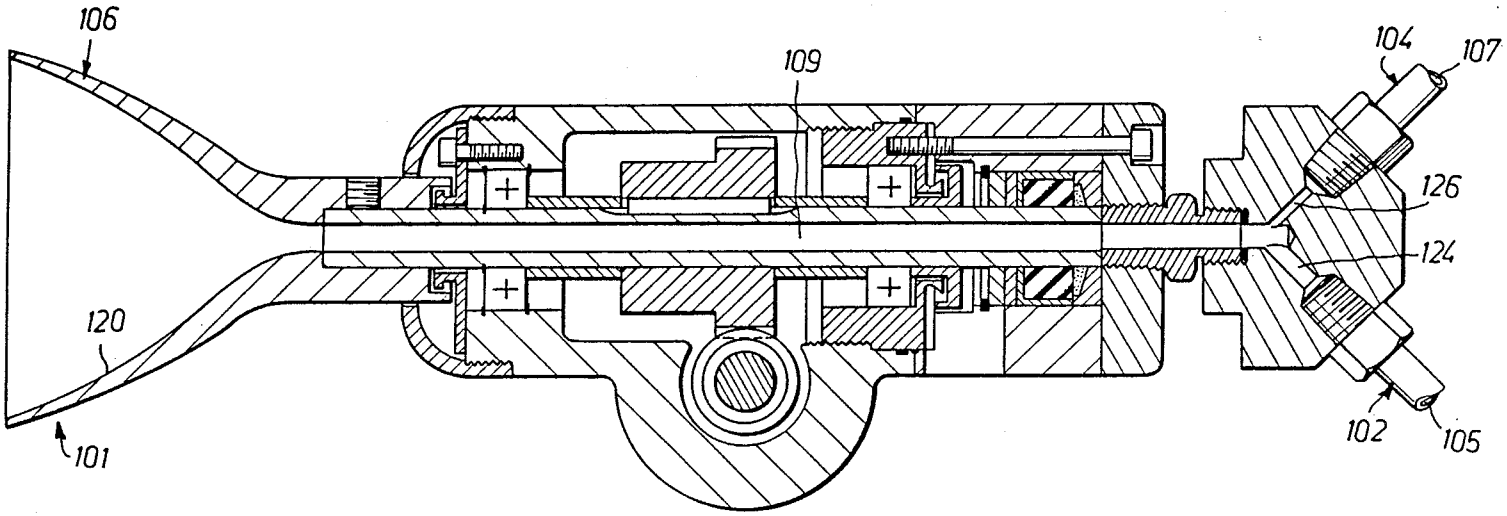
FIG. 2 shows a second embodiment of apparatus in accordance with the invention in which the neutral primer base and the pigmented paste are mixed upstream from a rotary bowl by axial injection.

With reference to FIG. 2, a variant embodiment is capable of axial injection. Parts having functions identical to parts shown in FIG. 1 are designated by the same reference numerals plus 100.

In this variant embodiment, the neutral base and the pigmented paste are mixed upstream from the rotary bowl 106 with the independent ducts for feeding neutral primer base 105 and pigment paste 107 terminating in a common axial duct 109 which in turn opens out into the rotary bowl 106, thereby showing that the invention is not limited to one particular method of mixing, but on the contrary relates to a wide range of possible embodiments. Thus, the invention includes any means constituting technical equivalents of the means described, together with various combinations thereof.

Static mixers (e.g. knucklebone tubes) or dynamic mixers (e.g. mixer turbines) may be disposed upstream from the projector head, but practical tests have shown that they are not useful. In the present description and claims, the term "neutral primer base" designates, in particular, a base having a substantially neutral color obtained using little or no pigment but which may contain possibly large quantities of additives which do not provide opacifying ability, such as talc, kaolin, barite or barium sulfate, etc. The use of such additives makes it possible to achieve pigment concentrations per unit volume which are identical or at least similar between the neutral primer base and the pigmented paste. Further, the two components of the primer are formulated using identical resin balances giving rise to a high degree of compatibility between the two components so that they mix quickly and easily and helping to ensure that the properties of the final product remain constant even if there are variations in the metering ratios.

A test of appearance after grit blasting has been performed and evaluated by spectrophotocolorimetric measurements.

A paint system is subjected to gritting. The gritting reveals the generally gray primer through a given surface. The revelation of this color contrast can be evaluated by measuring the change in color between the gritted zone and a non-gritted zone.

By replacing a conventional gray primer with a "false color" primer in accordance with the invention, the same measurements may be performed and the results compared, thereby showing the improvement factor obtained by the invention (see table on next page).

| Finishing color | GRITTING TEST Color classification H | L | S | Color change X | Y |
|---|---|---|---|---|---|
| Red | 80.4 | 41.8 | 79.6 | 8.36 | 99.46 |
| Maroon | 43.0 | 28.1 | 28.7 | 15.70 | 81.01 |
| Metallic red | 65.9 | 39.9 | 58.2 | 1.00 | 87.14 |
| Average | 63.1 | 36.6 | 55.5 | 8.36 | 89.20 |
| False color primer (invention) | 70.0 | 35 | 62 | | |

The improvement factor is given by the ratio of the average change using gray primer divided by the average change using false colored primer, giving 89.2/8.36, which is approximately equal to 10.

We claim:

1. A method of depositing by projection or spraying using a projection or spray device a primer or sealer of programmed color on an object comprising feeding independently to the projection or spray device a neutral primer base and at least one mono- or poly-pigmented paste said base and said paste being fed in such a manner as to cause them to be mixed in the device simultaneously while being projected or sprayed on said object, whereby said neutral primer base and said pigmented paste are mixed in order to constitute said primer at substantially the moment the primer is deposited on said object.

2. A method according to claim 1, wherein the pigmented paste is regulated to achieve the desired primer color.

3. A method of depositing by projection or spraying using a projection or spray device, a primer or sealer of programmed color on an object, comprising feeding independently to the projection or spray device a neutral primer base and at least one mono- or poly-pigmented paste in such a manner as to cause them to be mixed in the device simultaneously while being projected or sprayed on said object, whereby said neutral primer base and said pigmented paste are mixed in order to constitute said primer at substantially the moment the primer is deposited on said object, wherein the device is an electrostatic deposition device comprising a rotary bowl, and the base and paste are independently fed to the bowl

4. A method of depositing by projection or spraying using a projection or spray device a primer or sealer of programmed color on an object in which initially a neutral primer base and at least one mono- or poly-pigmented paste are fed independently to the projection or spray device in such a manner as to cause them to be mixed in the device simultaneously while being projected or sprayed on said object, whereby said neutral primer base and said pigmented paste are mixed in order to constitute said primer at substantially the moment the primer is deposited on said object, including the following steps:

(a) classifying and grouping all of the finishing colors into families depending on their colorimetric characteristics, which are measured by means of a spectrophotocolorimeter;

(b) determining the average colorimetric values of the colors of each family for giving to the primer of each family and in such a manner as to determine the formulation of the corresponding pigmented compositions;

(c) preparing the pigmented pastes corresponding to said compositions;

(d) preparing a neutral primer base having substantially the same pigment concentration per unit volume as the pigmented paste selected in this manner; and (e) feeding the neutral pigment base and the pigmented paste independently to the device for spraying or projecting primer onto said object.

5. A method according to claim 1 in which the object is a motor vehicle body .

6. A method according to claim 2 in which the object is a motor vehicle body work.

7. A method according to claim 3 in which the object is a motor vehicle body.

* * * * *